US006045397A

United States Patent [19]

Iwamura et al.

[11] Patent Number: 6,045,397

[45] Date of Patent: Apr. 4, 2000

[54] ELECTRICAL CONNECTION STRUCTURE OF CONNECTOR DEVICE

[75] Inventors: Moritaka Iwamura, Hamamatsu; Tetsuya Sagawa, Kodaira, both of Japan

[73] Assignees: The Whitaker Corporation, Wilmington, Del.; Nisshinbo Industries, Inc., Tokyo, Japan

[21] Appl. No.: 09/205,774

[22] Filed: Dec. 2, 1998

[30] Foreign Application Priority Data

Dec. 2, 1997 [JP] Japan ..... 9-347251

[51] Int. Cl.[7] ..... H01R 12/24

[52] U.S. Cl. ..... 439/493; 439/572; 174/138 G

[58] Field of Search ..... 439/493, 572, 439/567, 63, 76.2, 581, 34, 544, 56; 361/785, 775; 174/138 G, 52.1

[56] References Cited

U.S. PATENT DOCUMENTS

| | | | |
|---|---|---|---|
| 4,797,112 | 1/1989 | Weisenburger . | |
| 4,821,152 | 4/1989 | Lorenzen | 174/138 G |
| 4,842,525 | 6/1989 | Galloway et al. . | |
| 5,149,280 | 9/1992 | Edgley . | |
| 5,186,638 | 2/1993 | Pusch | 439/493 |
| 5,452,948 | 9/1995 | Cooper et al. . | |
| 5,532,436 | 7/1996 | Moyers et al. | 174/138 G |
| 5,911,596 | 6/1999 | Antonuccio et al. | 439/493 |

OTHER PUBLICATIONS

AMP Application Specification 114–1016—Miniature AMP–IN (TM) Contacts, Rev S. Mar. 9, 1998.

*Primary Examiner*—Paula Bradley
*Assistant Examiner*—Tho Dac Ta

[57] ABSTRACT

The present invention provides a crack-free electrical connection structure between electrical components and a circuit board in a connector device by soldering electrical wires to through-holes of the circuit board. Retention members (40) formed integrally with the connector device have slots (36) and channels (58, 62) intersecting inside the slots (36). Projections (54) are located at an exit of each channel (58). Ends of electrical wires (90) are stripped to expose core conductors (92) and they are bent in a generally L-shape to be disposed in the respective channels (58, 62) of slots 36. The projections (54) keep the exposed core conductors (92) in position, thereby simplifying electrical connection with through-holes in the circuit board.

7 Claims, 4 Drawing Sheets

ELECTRICAL CONNECTION STRUCTURE OF CONNECTOR DEVICE

FIELD OF THE INVENTION

The present invention relates to an electrical connection structure of a connector device for electrically connecting electrical components and a circuit board in the connector device.

BACKGROUND OF THE INVENTION

A connector device including a solenoid coil is used in automobiles for an ABS (anti-skid brake system). The solenoid coil is provided with electrical wires to be inserted into and soldered to through-holes in a circuit board within the connector device.

Soldering portions of the electrical wires tend to have cracks due to vibration of the automobile transmitted directly to the circuit board, thereby causing a reliability problem of the electrical connections. In addition, since there are a large number of electrical wires, a special tool is required for alignment of the electrical wires with the through-holes in the circuit board, thereby adversely affecting assembling efficiency. Also, the location of the solenoid coil restricts positioning of connection portions between the electrical wires and the circuit board, thereby restricting design freedom of the circuit board layout.

In view of the above drawbacks, it is an object of the present invention to provide an electrical connection structure of a connector device capable of avoiding cracks due to vibration and thermal deformation.

It is an another object of the present invention to provide an electrical connection structure of a connector device that requires no special tool in assembling and being easy to assemble the connector device.

It is additional object of the present invention to provide an electrical connection structure of a connector device with larger design freedom.

SUMMARY OF THE INVENTION

An electrical connection structure of a connector device according to the present invention is for electrically connecting electrical components and a circuit board having through-holes accommodated in an insulating housing of the connector device. It features electrical wires led out of the electrical components and retention members provided in the housing for retaining end portions of the electrical wires and positioning exposed or stripped ends of the electrical wires to be inserted into and soldered to the through-holes in the circuit board.

BRIEF DESCRIPTION OF THE DRAWINGS

An embodiment of the present invention will now be described by way of example with reference to the accompanying drawings in which.

DETAILED DESCRIPTION OF THE INVENTION

Figure 1:
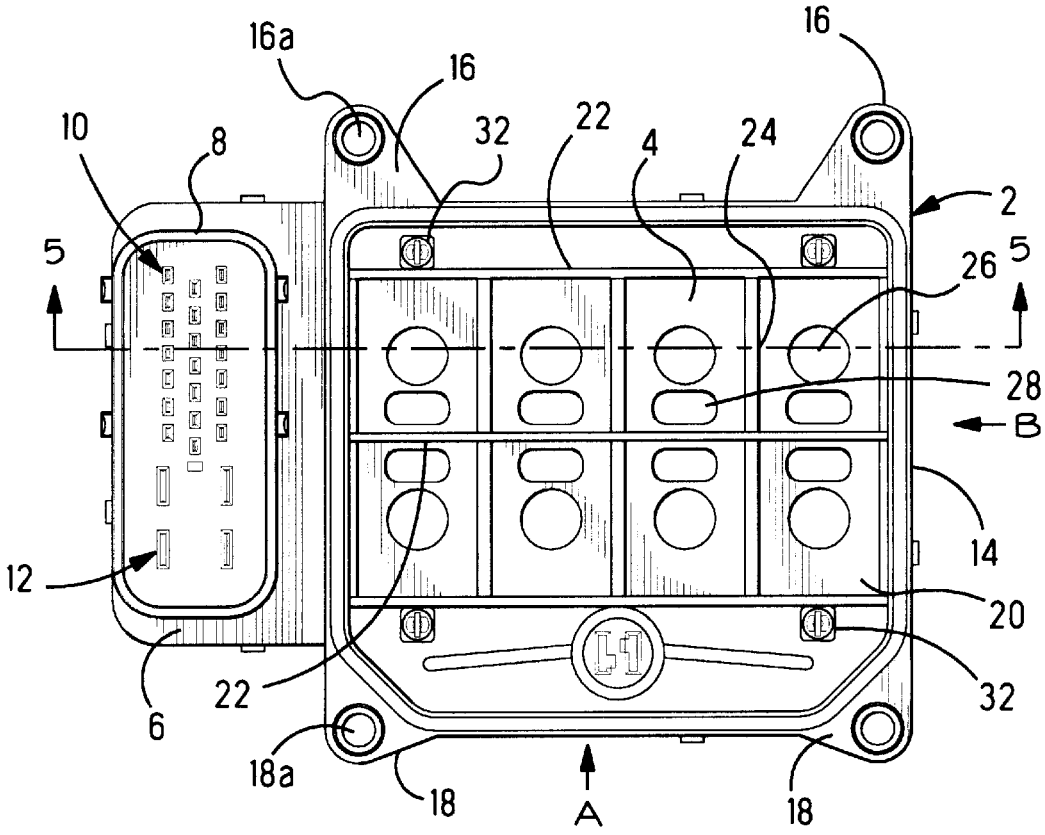
FIG. 1 is a top plan view of a housing of a connector device including an electrical connection structure according to the present invention.

Housing 2 as shown in FIG. 1 has a generally rectangular accommodation portion 4 for accommodating solenoids (not shown) and an upwardly-oriented connector portion 8 at an extended portion or extension 6 extending sideways from the accommodation portion 4. Located in the connector portion 8 are rows of electrical contact pins 10, 12 for electrical engagement with electrical contacts of a matable connector (not shown) for establishing electrical connection therebetween.

A main body 14 of the housing 2 has ears 16, 18 at corners thereof for mounting a liquid pressure control unit (not shown) thereto. Each of the mounting ears 16, 18 has a hole 16*a*, 18*a* through which a mounting bolt passes.

Crossing ribs 22, 24 in the bottom 20 of the accommodation portion 4 define cells. Each cell has a circular recess 26 for positioning a solenoid and an oval-shaped hole 28 in the bottom surface 20 adjacent to each other. Electrical wires 90 (see FIG. 7) of the solenoid pass through the hole 28, and they are led out of the bottom or opposite side of the housing 2. The solenoid is disposed in alignment with the circular recess 26 and is mounted by a hold-down plate (not shown) for retaining the solenoid in position after it is placed in circular recess 26 of its respective cell. The hold-down plate is formed with holes at locations corresponding to posts 32 bifurcated at their end portions in the accommodation portion 4, and the posts 32 extend through the holes in the hold-down plate to maintain it on the housing.

Figure 2:
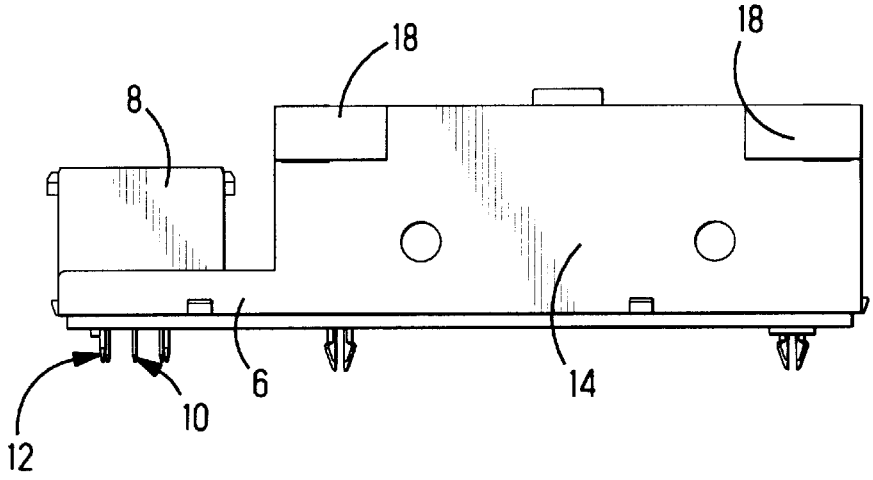
FIG. 2 is a side view of the connector device in FIG. 1 as seen from the direction of arrow A.

The mounting ears 18 as shown in FIG. 2 are located at an upper portion of the main body 14 which is also true for mounting ears 16. The positional relationship of the connector portion 8, the main body 14 and the extended portion 6 will be easily understood from FIG. 2.

Figure 3:
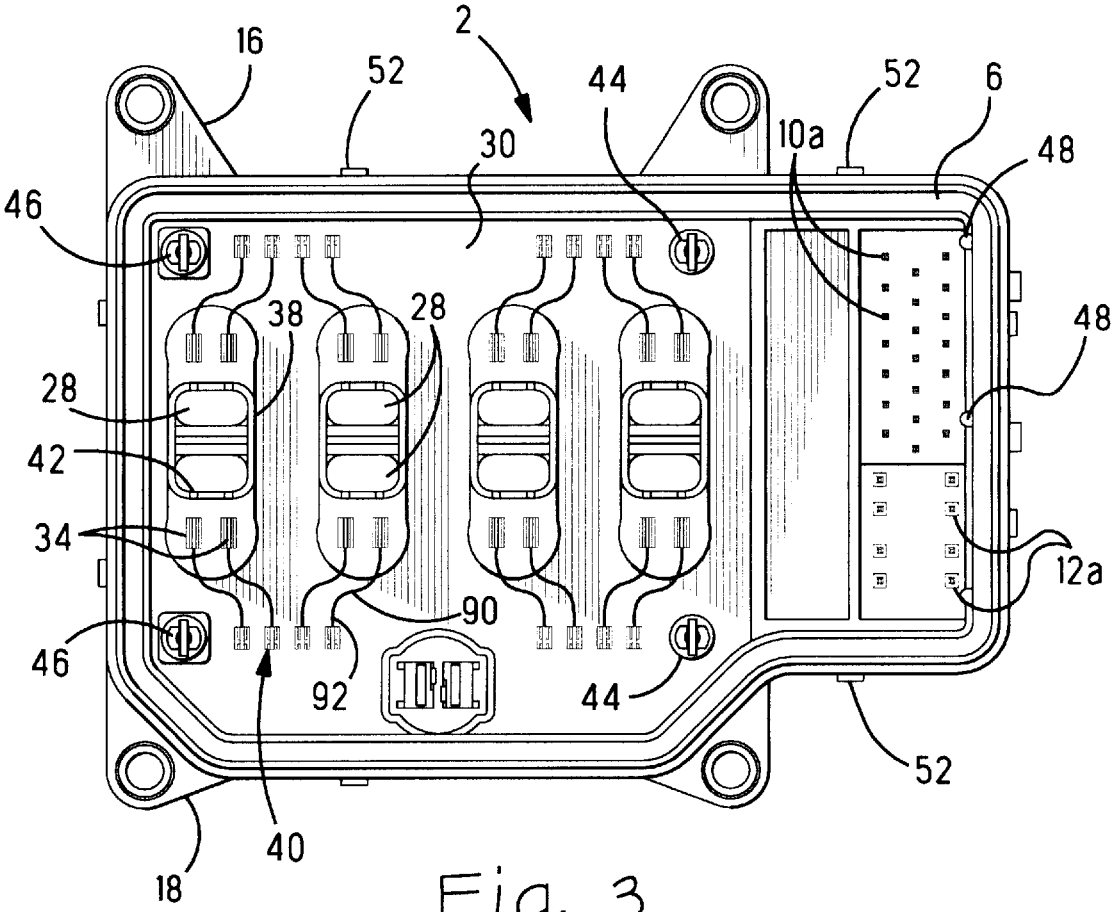
FIG. 3 is a bottom view of the connector device in FIG. 1

Tines 10*a*, 12*a* of the pins 10,12 extend from a bottom surface of the extended portion 6 as shown in FIG. 3. The main body 14 has a wire-accommodation portion 30 at a bottom side thereof for receiving the electrical wires 90 of the solenoids. The wire-accommodation portion 30 is shallow and it has pairs of holes 28 at four positions. Walls 38 integral with the housing 2 surround the holes 28. Channels 42 are located in each wall 38 for receiving the lead-out electrical wires 90. Formed integrally with the housing 2 outside each hole 28 are clamp portions 34 having slots 35 (see FIG. 5) for clamping the electrical wires. The clamp portions 34 are formed at the locations corresponding to the channels 42 and comprise opposed ribs 37 to define the slot 35. Retention members 40 corresponding to the clamp portions 34 spaced from the clamp portions 34 are provided in wire-accommodation portion 30. The clamp portions 34 are simply designed for clamping the electrical wires 90.

The electrical wires 90 led out of the holes 28 are clamped by the clamp portions 34 at insulation covered portions 94 (see FIG. 7) so that stripped end portions 92 are oriented upwardly at the retention members 40. In other words, the electrical wires 90 are retained with the stripped end portions 92 extending upwardly from the sheet of paper as described in detail hereinafter.

Figure 5:
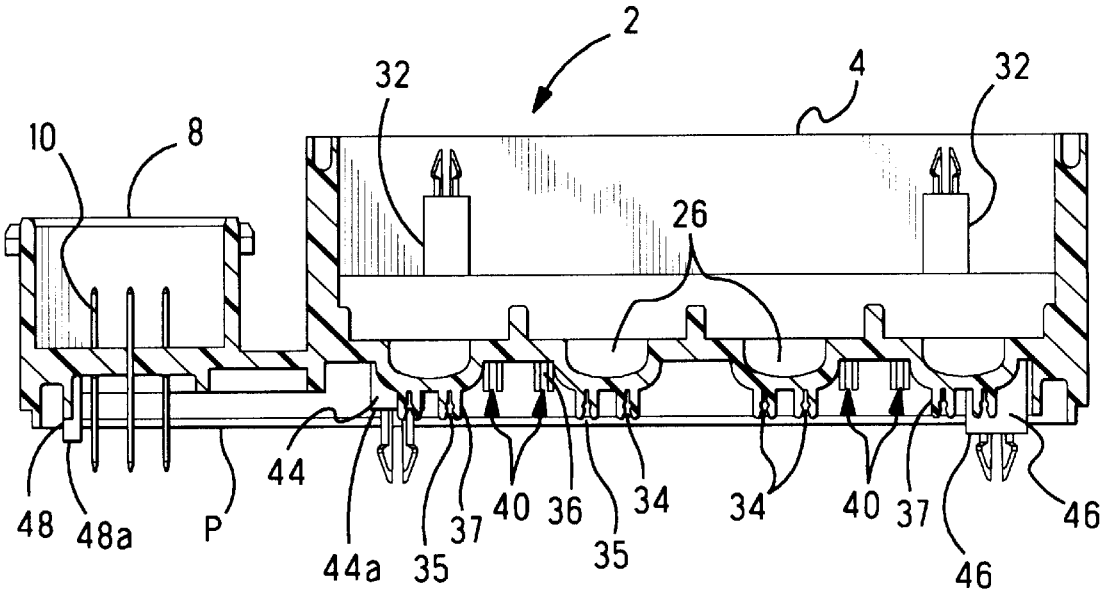
FIG. 5 is a cross-sectional view taken along line 5—5 in FIG. 1.

The wire-accommodation portion 30 is covered with a printed circuit board P (see FIG. 5). The circuit board P is sized to extend to the extended portion 6, and it has through-holes (not shown) for receiving the tines 10*a*, 12*a* and the end portions 92 of the electrical wires 90. The end portions 92 are oriented upwardly, and they are precisely aligned with the through-holes of the circuit board; thus, the circuit board P can be easily mounted from the front side. The end portions 92 and the tines 10*a*, 12*a* received in the respective through-holes are soldered. Flexibility of the electrical wires 90 allows positioning of the end portions 92 within the retention members 40 relatively freely.

Similar to the hold-down plate, the circuit board P can be mounted by posts 44, 46 at four locations of the wire-accommodation portion 30. The posts 44, 46 are bifurcated at their ends like the posts 32, and they are mounted by similar engagement with holes in the circuit board. When the circuit board P is mounted, the three posts 48 at the extended portion 6 are used for positioning of the circuit board P. After mounting of the circuit board P, a plastic cover (not shown) is mounted on the housing 2 by latch projections 52 for covering the circuit board P.

Figure 4:
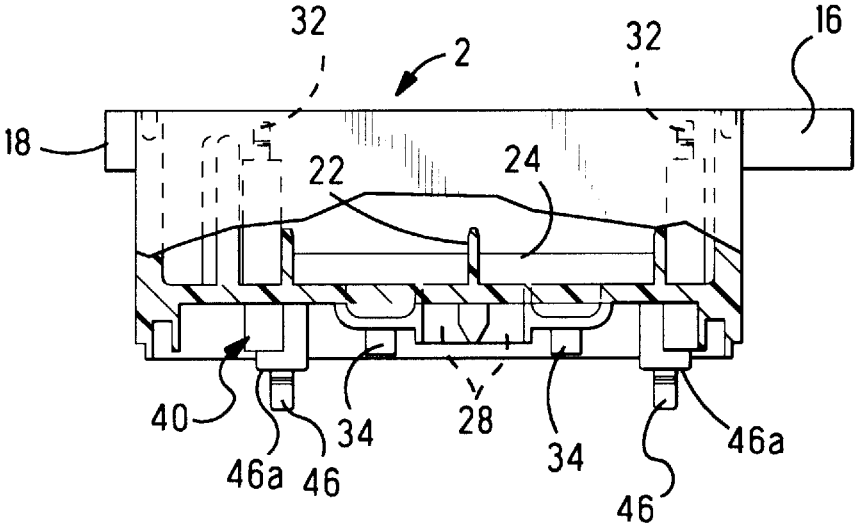
FIG. 4 is a front view that is partly broken away of the connector device in FIG. 1 as seen from the direction of arrow B.

As shown in FIG. 4, since the circuit board P is mounted in abutment against shoulders 46*a* of the posts 46, there is a clearance between the inner surface of the circuit board P and the retention members 40. The end portions of the flexible electrical wires can absorb deformation of the circuit board and mounting error by the length of the clearance, thus the soldered portions are unlikely to have cracks. Also, any stress by the movement of the electrical wires held by the retention members due to vibration does not affect the soldered portions, thereby preventing cracks.

FIG. 5 clearly shows the retention members 40, each having a slot 36. The circuit board P is placed against shoulders 44*a* of the posts 44 and abutment surfaces 48*a* of the posts 48. Note that the shoulders 44*a* of the posts 44 are short and do not abut against the surface of the circuit board P. Clearance between the shoulders 44*a* and the circuit board P is designed to absorb warping of the circuit board P or its mounting tolerance.

Figure 6:
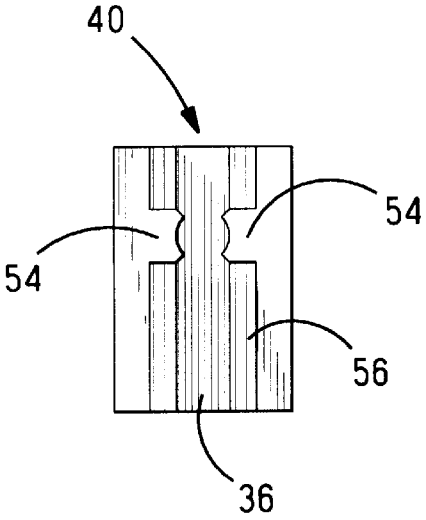
FIG. 6 is a plan view of a retention member.
Figure 7:
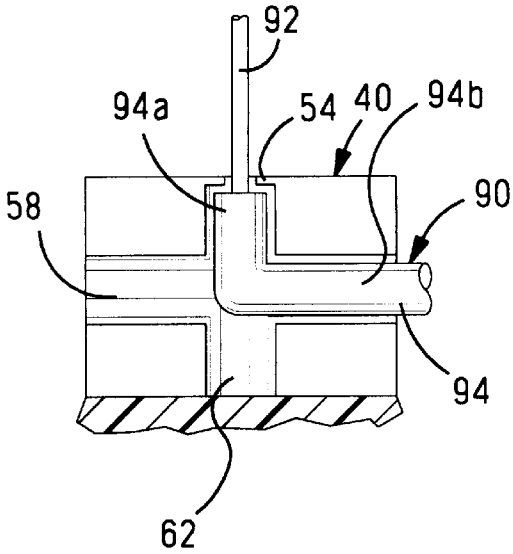
FIG. 7 is a cross-sectional view of the retention member.
Figure 8:
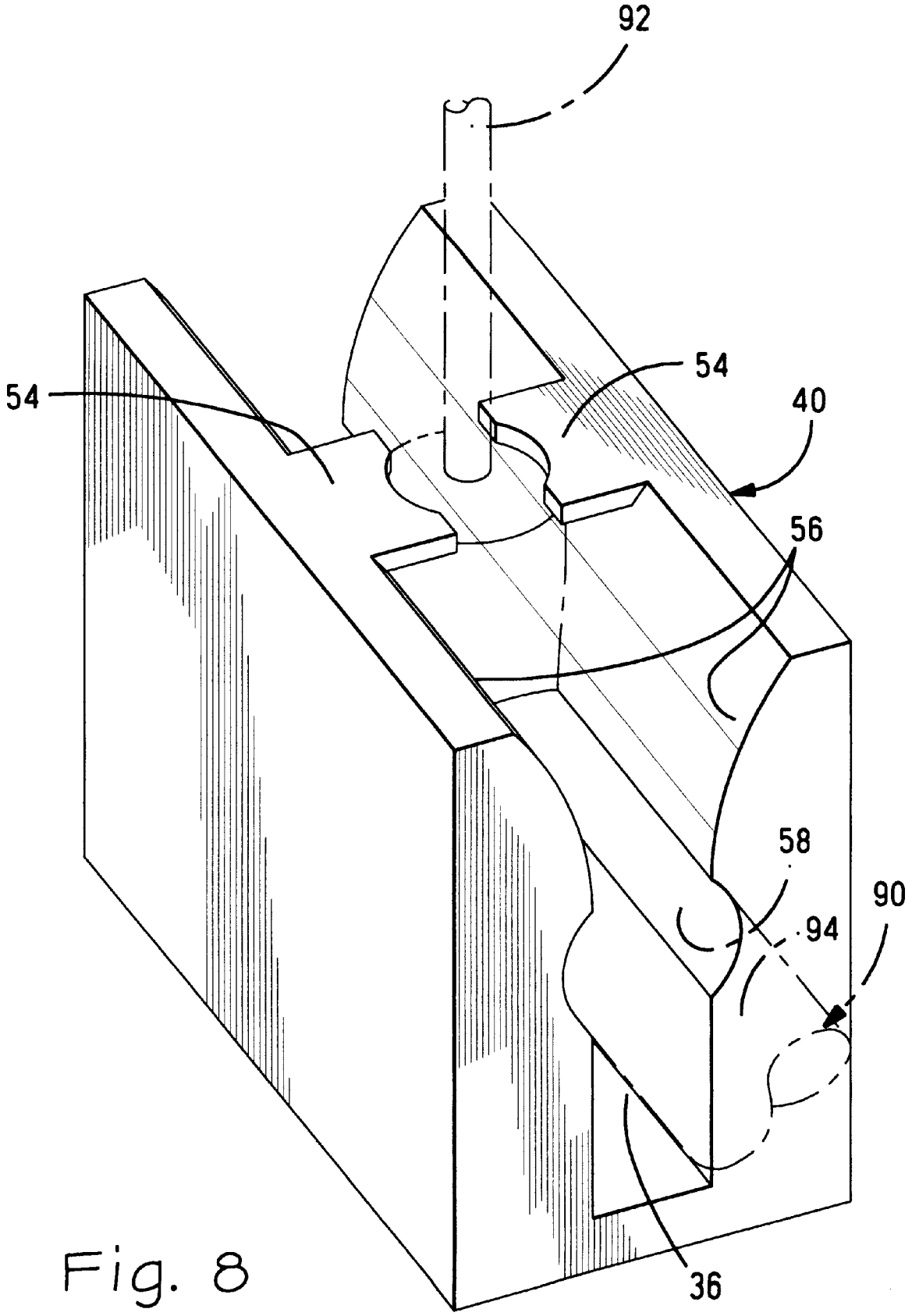
FIG. 8 is a perspective view of the retention member.

Now, reference is made to FIGS. 6–8 to describe the retention members 40 in detail. In FIG. 6, positioning projections 54 have arcuate inner ends, and they extend into the slot 36. The end portions of the electrical wires 90 are held in position by the projections 54. An upper end of the slot 36 has a taper 56 for guiding the electrical wire 90 to be inserted therein.

Reference is now made to FIG. 7 and FIG. 8 showing the electrical wire 90 held in the slot 36. The insulation cover 94 of the electrical wire 90 is held in a horizontal channel 58 and a vertical channel 62 of the slot 36, each having a curved inner surface. The core conductor of the electrical wire 90 is a tin coated copper wire surrounded by the insulation cover, which is relatively rigid but flexible. As a result, the electrical wire 90 can be held in the channels 58, 62 while maintaining a relatively right-angled or L-shaped orientation. The stripped end portion 92 is prevented from moving upwardly by the projections 54 because the insulation cover 94 abuts against the projections, thereby leaving only the stripped core conductor 92 extending upwardly from the projections 54.

FIG. 8 shows the upwardly-oriented end portion 92 including the insulation covered portion 94*a* and the horizontal portion 94*b*, which are held respectively in the channels 58, 62. The channels 58,62 and the projections 54 are collectively referred to as a wire-positioning means.

Although the preferred embodiment of the present invention has been described in detail hereinbefore, it is to be understood that the present invention should not be limited only to such embodiment. A person having an ordinary skill in the art will understand that various modifications can be made without departing from the scope and spirit of the present invention.

The electrical connection structure of the connector device according to the present invention features a housing for holding stripped end portions of electrical wires and also having retention members for positioning the stripped end portions of the electrical wires for inserting into and soldering to the respective through-holes in the circuit board, thereby exhibiting the following advantages:

Flexibility of the electrical wires can absorb any deformation of the circuit board or assembling tolerance, thereby preventing any crack in the soldered portions. Also, the retention members keep any stress due to vibration away from the soldered portions of the electrical wires and the through-holes to which they are soldered, thereby preventing any crack therein. The connector device is easy to assemble because no special assembling tool is required. In addition, the stripped end portions of the electrical wires can be located relatively freely, thereby providing relatively large design freedom in the location of the soldering portions.

We claim:

1. An electrical connection structure for electrical components and for positioning exposed end portions of electrical wires of the electrical components for insertion into through-holes of a circuit board, comprising a housing having component-receiving areas along an upper surface for receiving the electrical components and holes through which the electrical wires of the electrical components extend;

a wire-accommodation area along a bottom surface of the housing; and retention members extending outwardly from the bottom surface in which ends of the electrical wires are retained with the exposed end portions being oriented for insertion into the through-holes of the circuit board, wherein the retention members have a slot provided with a horizontal channel and a vertical channel so that the electrical wires retained therein assume an L-shape with the exposed end portions extending outwardly therefrom.

2. An electrical connection structure as claimed in claim 1, wherein the vertical channel includes positioning projections between which the exposed end portions are disposed as they extend outwardly from the retention members and against which insulation of the electrical wires engage.

3. An electrical connection structure as claimed in claim 1, wherein board-mounting members extend outwardly from the bottom surface for mounting the circuit board thereon.

4. An electrical connection structure as claimed in claim 1, wherein posts extend outwardly from the upper surface for mounting a hold-down plate thereon.

5. An electrical connection structure as claimed in claim 1, wherein the housing has an extension on which an electrical connector having rows of electrical contacts is located.

6. An electrical connection structure as claimed in claim 1, wherein walls extend outwardly from the bottom surface surrounding the holes, and channels are located in the walls in which the electrical wires are positioned.

7. An electrical connection structure as claimed in claim 6, wherein clamp portions extend outwardly from the bottom surface between the walls and the retention members for clamping the electrical wires therein.

* * * * *